US005167327A

United States Patent [19]

Mondello

[11] Patent Number: 5,167,327

[45] Date of Patent: Dec. 1, 1992

[54] SHIPPING, STORING AND LOADING SYSTEM FOR FASTENER COLLARS

[75] Inventor: Brian C. Mondello, Rhineback, N.Y.

[73] Assignee: Huck Patents, Inc., Wilmington, Del.

[21] Appl. No.: 599,184

[22] Filed: Oct. 17, 1990

[51] Int. Cl.[5] ..... B65D 85/02

[52] U.S. Cl. ..... 206/338; 221/312 A

[58] Field of Search ..... 206/338-348, 206/303, 445, 493; 221/312 A, 312 B; 29/282, 809, 816; 294/158

[56] References Cited

U.S. PATENT DOCUMENTS

| | | | |
|---|---|---|---|
| 2,882,170 | 4/1959 | Stewart | 206/303 |
| 2,930,503 | 3/1960 | Hamlin et al. | 206/338 |
| 4,300,684 | 11/1981 | Smith et al. | 206/338 |
| 4,364,804 | 8/1982 | Powderly | 206/493 |
| 4,789,064 | 12/1988 | Segal | 206/493 |

*Primary Examiner*—Jimmy G. Foster

*Attorney, Agent, or Firm*—Harness, Dickey & Pierce

[57] ABSTRACT

A method and apparatus for loading fastener collars of the lockbolt variety into a tubular magazine associated with a fastener collar-feeding apparatus. Collars are stacked on an elongated flexible mandrel, after which the mandrel-collar assembly is inserted as a unit into the tubular magazine. The mandrel is then pulled out of the magazine while deforming a collar retainer provided on the mandrel thereby releasing the collars from the mandrel and leaving the collars loaded in place within the magazine.

10 Claims, 2 Drawing Sheets

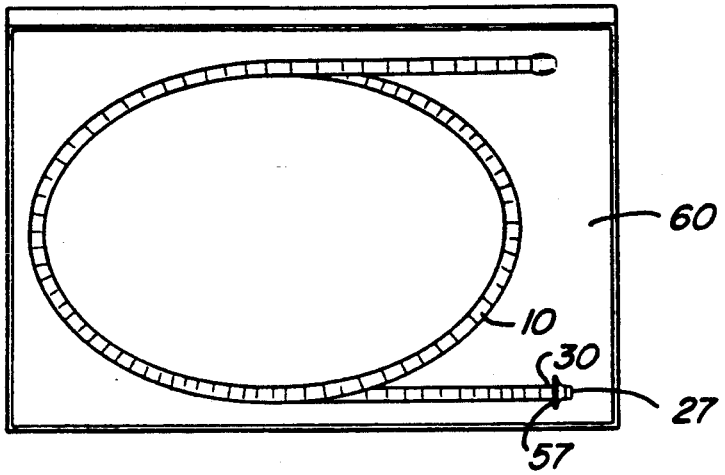
Fig-3
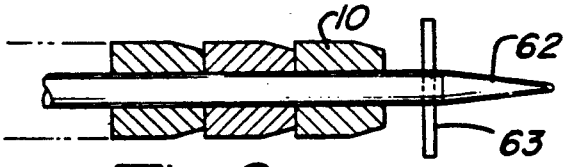
Fig-8
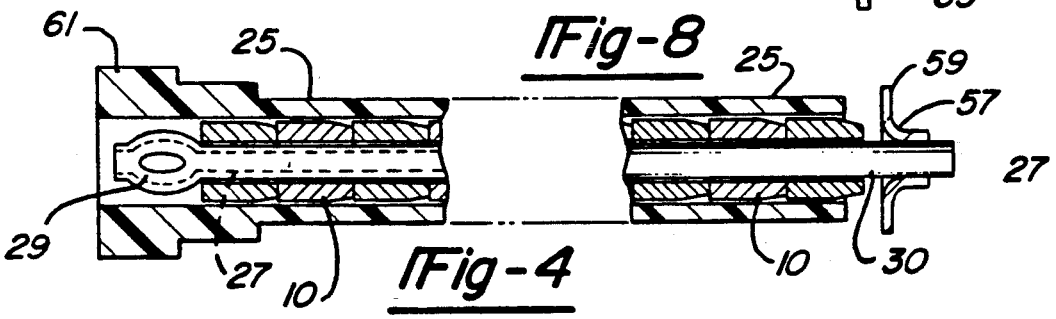
Fig-4
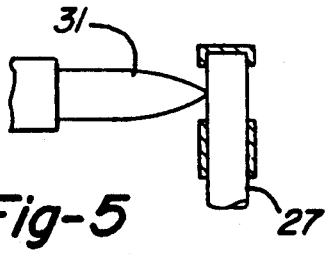
Fig-5
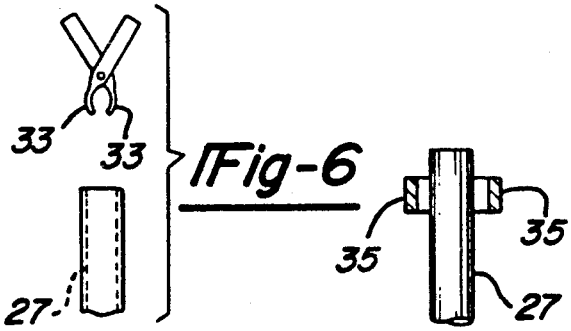
Fig-6
Fig-7

SHIPPING, STORING AND LOADING SYSTEM FOR FASTENER COLLARS

BACKGROUND OF THE INVENTION

1. Field of the Invention

This invention relates to an apparatus and method for introducing fastener collars into tubular magazines associated with fastener installation machines which feed the collars onto the exposed ends of fastener pins. A series of collars strung on a flexible mandrel is inserted within a tubular magazine and released from the mandrel thereby loading the magazine.

2. Description of Prior Developments

Fasteners of the pin and collar variety are used in aircraft construction for fastening panels to frames, e.g. to form aircraft wings and aircraft fuselages. Each fastener or lockbolt includes a pin having a head and shank portion extendable through aligned circular openings in the workpieces that are to be fastened together. A cylindrical collar is placed on the exposed shank portion of the pin, after which a fastener-setting tool is operated to swage the collar into and around grooves formed in the shank portion of the pin.

The present invention is concerned with devices for placing the cylindrical collars on shank portions of the lockbolt pins prior to the fastener-setting operation. Existing collar-feeding devices are supplied with collars through flexible tubular magazines that are pre-loaded with collars which are arranged serially in end-to-end relation. A pressure source associated with the collar-feeding device forces the collars out of the tubular magazine and into the collar-feeding device as required to locate each collar in position for feeding onto a fastener pin.

The tubular magazines are configured as elongated flexible tubes, each about twelve feet long. Each fastener has a diameter varying from about one fourth inch to about one half inch depending on the size of the associated lockbolt. Each collar has an axial length that approximates the collar diameter. It can be seen that each tubular magazine will contain a fairly large number of fastener collars, e.g. several hundred or more collars arranged end-to-end within the magazine.

Each tubular magazine is typically loaded with collars by an operator of a fastener installation machine at an installation site by temporarily attaching one end of the magazine to a vibratory bowl apparatus containing large numbers of fastener collars. Vibratory motion of the bowl causes the fastener collars to move in a circular fashion around the bowl periphery and upwardly along a curved ramp leading to a vertical chute. An optional collar orientation device may be provided at the end of the ramp to axially orient assymetrically shaped collars prior to their entry into the vertical chute. The collars migrate into the chute, where they drop into the tubular magazine that extends downwardly from the chute. The remote end of the tubular magazine is connected to a vacuum source, such that a vacuum force is applied to the collars to draw them along the tubular magazine so as to substantially fill the magazine along its entire length.

One drawback to this method of on site loading of the magazines with collars is that the one or more vibratory bowls are typically required at each installation site. These magazine loading machines not only require significant floor space but are also quite expensive. Moreover, the vibratory bowls and associated collar feeding apparatus require significant maintenance and are prone to malfunction and breakdowns which necessitate immediate attention and repair.

Another drawback associated with the existing method of filling the tubular magazines with fastener collars at an end-user installation site is that dirt, metal chips and other debris can be drawn into the magazine from the vibratory bowl along with the fastener collars. Also, the fastener collars will sometimes be accompanied by slugs of metal produced during the collar manufacturing operation. These slugs are cylindrical plug-like elements that are punched out of the collar material to form the annular collar configuration. Occasionally a slug will remain loosely attached to a formed collar, or a detached slug may be mixed in with collars received from the collar-manufacturing facility. Should slugs or other contaminants get into the magazine, the collar feeding device can become jammed, malfunction and/or cause damage to the workpieces being fastened.

Another problem related with loading collars within a collar storing and feeding magazine is that sometimes collars of one diameter will inadvertently become mixed in the vibratory bowls with collars of a different diameter. As a result, collars of a relatively small diameter can be introduced into magazines containing larger diameter collars. When the collar feed device attempts to feed the small diameter collar onto a large diameter lockbolt pin the feed mechanism can jam or otherwise malfunction thereby necessitating a rework of the workpieces being fastened. The same situation can develop if assymmetrical or "beaded" type collars are being fed if one or more collars are incorrectly axially inverted or loaded "upside down" in the magazine. In some cases, the collars can be incorrectly loaded sideways, or rotated 90° from their correct or desired orientation. This is particularly the case with axially short length collars.

Still another problem associated with current collar loading techniques is the loss of a wax-like lubricant coating from the surfaces of the collars as the collars impact against one another in the vibratory bowls. Lubricant can also become ineffective if exposed to the ambient for extended periods of time. Once the lubricant is lost or degraded, the collars resist removal from the installation tooling after being swaged over a fastener pin. This condition can cause the installation tooling to jam.

When the collar outer surface is bare, i.e. non-lubricated, the swaging die encounters increased resistance which leads to increased stress on the die and elevated ejection forces required to separate the swaging die from the collar after the fastener-setting operation. The service life of the swaging die may be adversely affected by the absence of a lubricant film on the collar outer surface.

With existing procedures, lubricant film is applied to each collar before it is introduced into the vibratory bowl apparatus used to feed collars into the tubular magazine. The vibratory action of the bowl causes the collars to repeatedly rub against one another, so that the lubricant film is, to a large extent, rubbed off the collar surface. This loose lubricant has in the past contaminated the surfaces of the vibratory bowl and sorting and feed apparatus thereby necessitating maintenance and repair.

SUMMARY OF THE INVENTION

The present invention relates to an apparatus and method for loading tubular magazines with fastener collars without introducing slugs, contaminants, wrong sized or incorrectly oriented collars into the magazine. In practicing the invention, collars are sequentially fed onto an elongated flexible mandrel such that any slugs or contaminants are discarded or shed from the mandrel surface. The collars initially fit around the mandrel rather than within a tube such that slugs and undersize collars cannot encircle or stay supported on the mandrel surface. Any collar which is loaded on the mandrel in an upside down orientation can be easily detected and removed prior to loading in a magazine so as to facilitate inspection and quality control of the collars prior to use.

This mandrel-collar assembly is inserted into a tubular magazine to a point where all of the collars are within the magazine. The flexible mandrel is then pulled out of the magazine. A releasable collar retainer located on the inner end of the mandrel collapses or releases when the mandrel is pulled out of the magazine thereby leaving the collars in place within the magazine.

Prior to insertion of the mandrel-collar assembly into the magazine, the assembly is immersed, sprayed with or dipped into liquid lubricant. The lubricant is allowed to dry so as to form a lubricant film on the outer surfaces of each collar. The lubricant facilitates motion of a swaging die or anvil over the collar surface during the fastener-setting operation. The assembly then may be packaged in a vacuum sealed container such as a plastic bag so as to prevent evaporation or atmospheric contamination or breakdown of the lubricant. This ensures a long shelf life for the collar storing and loading assembly.

With the present invention the lubricant is preferably applied to each collar after it has been sorted in a vibratory bowl and assembled onto a flexible mandrel. The lubricant is therefore largely intact on each collar as the mandrel-collar assembly is inserted into the tubular magazine. Thus, the lubricant is present on each collar when it is needed and contamination of the vibratory bowls by the lubricant is prevented.

THE DRAWINGS

FIG. 3 shows a mandrel-collar assembly produced by operation of the FIG. 2 apparatus.

FIG. 4 shows the mandrel-collar package of FIG. 3 in a position inserted into a tubular magazine.

FIGS. 5, 6 and 7 are fragmentary views illustrating mechanisms for forming collapsible retainers on the mandrel shown in FIGS. 2 and 4.

FIG. 8 shows a structural detail that can be used on the mandrel of FIGS. 2 and 4, as an alternate retainer configuration.

DESCRIPTION OF THE PREFERRED EMBODIMENT OF THE INVENTION

Figure 1:
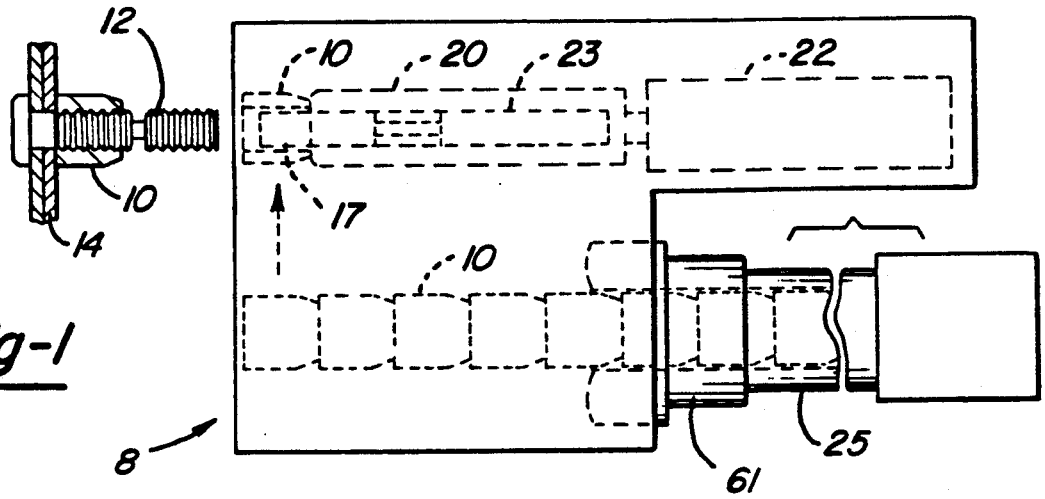
FIG. 1 is a schematic representation of a conventional collar feeding apparatus having a tubular magazine for containment of collars to be used by the apparatus.

FIG. 1 schematically shows a conventional device 8 for feeding annular collars 10 onto a lockbolt pin 12 extending through aligned openings in workpiece panels 14. The device includes a pin 17 slidably accommodated in an annular piston 20 extending from a fluid cylinder 22. Another fluid cylinder 23 is located within piston 20 for extension or retraction of pin 17 relative to the piston. Operation of the feeding device enables a collar 10 to be shifted from the device onto lockbolt pin 12.

Collars are supplied to feeding device 8 from a flexible tubular magazine 25 that extends from the feeding device for a considerable distance, e.g. about twelve feet. Only a short section of the tubular magazine is shown in FIG. 1. Once the magazine has been loaded and filled with collars it is attached to feeding device 8, such that during operation of the feeding device collars are fed under pressure from magazine 25 into the feeding device. A pressure line associated with device 8 blows the collars from the magazine into position for subsequent transfer to a point in alignment with pin 17 and feeder portion 20.

Figure 2:
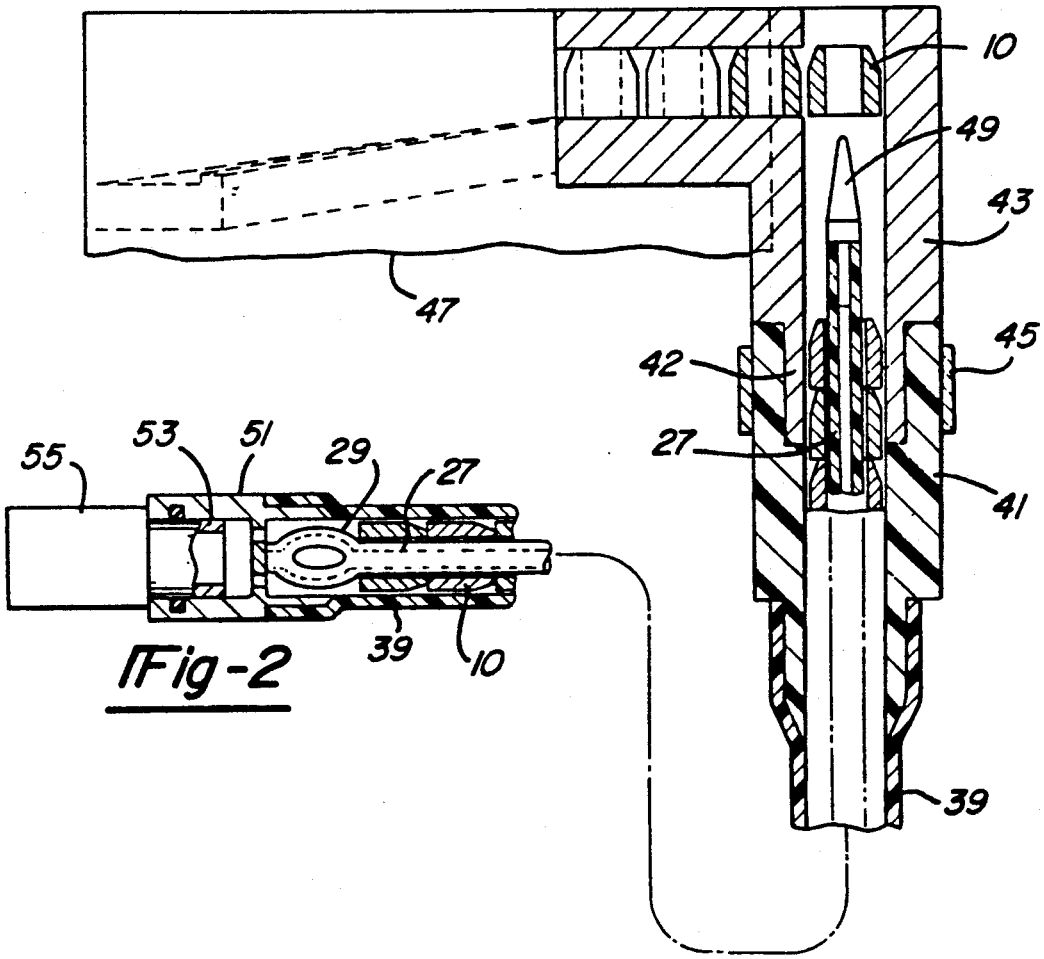
FIG. 2 shows an apparatus according to the present invention useful for inserting fastener collars into a tubular magazine forming part of the FIG. 1 apparatus.

FIG. 2 shows an apparatus for feeding or stringing collars 10 onto and along a flexible mandrel 27. Mandrel 27 will preferably have a length slightly less than the length of magazine 25, e.g. less than twelve feet to allow for the presence of a small number of unused collars which may be remaining within the magazine from prior applications. The mandrel is preferably formed of small diameter flexible plastic tubing, e.g. polyethylene tubing, having a smooth circular outer surface. The tubing diameter is in a range from about one eighth inch to about one half inch, depending on the diameter of the associated metal collars 10. Each collar has a slidable fit on the surface of mandrel 27. Although it is desirable to mechanically string the collars onto mandrel 27 as outlined above in connection with the apparatus of FIG. 2, it is of course possible to perform this function manually.

One end of mandrel 27 is deformed to form a releasable or collapsible retainer 29. Collapsibility is built into retainer 29 so that when collars 10 are trained on the mandrel the retainer will prevent the collars from moving past the retainer under normal handling conditions, i.e. when the collar-laden mandrel is being handled or being transported or shipped from one facility to another. However, retainer 29 is constructed so that when a significant axial manual force is exerted on the retainer 29 by endwise pressure from the associated collars 10, the retainer will release or collapse radially inwardly to enable the collars to pass over the retainer and off of mandrel 27.

FIG. 5 shows one way in which retainer 29 can be formed. A heated blade 31 is driven rightwardly transversely through plastic tube 27 to form slits in the tube walls. The heated blade has an oblong cross section so as to bulge the tube walls outwardly as shown in FIGS. 2 and 4.

FIG. 6 shows an alternate apparatus wherein heated convex spherical elements 33 are insertable into the end of the tube and then spread apart to form an outward bulge in the tube wall.

FIG. 7 shows an apparatus wherein two heated plates 35 are squeezed against outer surfaces of the tube to flatten the tube and bulge it outwardly normal to the plane of the paper.

In each case (FIGS. 5, 6 and 7) the deforming element may be heated or the tube may be heated by other means so that after the deforming operation the mandrel material will not return to its initial circular surface configuration. The bulge-type retainer is however collapsible back into the tube diameter in response to endwise pressure from the associated collars 10.

The collar-feeding apparatus of FIG. 2 includes an elongated flexible tube 39 having an upper end fitting 41 adapted to encircle a spigot 42 formed on a chute structure 43. A manual clamp 45 is associated with end fitting 41 to enable the fitting to grip spigot 42 while permitting easy separation of the fitting from the spigot. Chute structure 43 is attached to a vibratory bowl mechanism 47 that includes a helical ramp for advancing collars upwardly into the vertical chute space for gravitational deposition onto the upper end of mandrel 27. A tapered nose piece 49 is removably fitted onto tube 27 to guide each collar onto the tube. If for any reason the collar is the wrong size it will not be deposited onto tube 27 because the collar opening is too small or because the collar outside diameter is too large. The nose piece may be initially inserted in fitting 41 with a loose fit which allows the tapered end of the nose piece to self center itself in fitting 41 once the collars are drawn into tube 39 via suction.

More particularly, gravitational forces are augmented by the use of suction forces. As shown in FIG. 2, the remote end of tube 39 has an end fitting 51 adapted to connect with a pipe 53 extending from a vacuum source 55. The vacuum source is operated while bowl 47 is vibrating, such that the collars are closely packed together on flexible mandrel 27. When the mandrel is covered to a point near its upper end 30, the suction tube 39 is detached from chute structure 43. Nose piece 49 is then removed from tube 27 and exposed end portion 30 of the tube pulled to remove the mandrel-collar package from suction tube 39.

As the next step in the operation, a second retainer 57 (FIGS. 3 and 4) is attached to end portion 30 of tube 27. Retainer 57 can be a conventional speed clip having a radial flange 59 and a central annular portion frictionally grippingly connected to the outer surface of tube 27. The diameter of flange 59 is substantially greater than the diameter of each associated collar 10, so that when the mandrel-collar package is later inserted into tubular magazine 25 (FIG. 4) the package must be inserted with the smaller diameter retainer 29 extending into the magazine.

As shown in FIG. 4, retainer 57 is located outside the magazine. The mandrel-collar package is inserted into magazine 25 in a right-to-left direction (FIG. 4). The left end of magazine 25 may be provided with a conventional quick disconnect fitting at end portion 61.

Prior to insertion of the mandrel-collar assembly into magazine 25, a lubricant film may be applied to each collar outer surface. This may be accomplished by dipping the mandrel-collar assembly into a tank containing a suitable quantity of liquid lubricant, e.g. cetyl alcohol. When the lubricant is dry the lubricant-coated assembly may be coiled into a compact shape and placed in an air-tight, preferably vacuum packed and sealed polyethylene bag 60 or similar hermetic shipping container as seen in FIG. 3 for transportation from one facility to another.

The facility which produces the mandrel-collar assembly of FIG. 3 can be geographically remote from the facility where the feeding device of FIG. 1 is located. This can save floor space and reduce the need for numerous vibratory bowls at each point of end use. In fact, an end user need not invest in any collar loading equipment as the mandrel-collar assembly shipped from a remote centralized loading facility obviates all on-site mechanized collar loading.

FIG. 4 shows the mandrel-collar assembly 27, 10 fully inserted into magazine 25. The mandrel is withdrawn from the magazine by exerting a manual pulling force on the right end of the mandrel. One hand of an operator may pull rightwardly on flange 59 while the other hand holds the adjacent collars 10 from moving rightwardly by applying a leftward reaction force. Collapsible retainer 29 thereby applies an axial pressure on the stack of collars, whereby the retainer radially collapses so as to pass through the collars. The hand holding the collars may also hold the magazine 25 from moving during withdrawal of the mandrel.

When mandrel 27 is fully withdrawn from magazine 25 the magazine is attached to feeding device 8, as shown generally in FIG. 1. After the magazine has been emptied it is either loaded with a new batch of collars, or the magazine is replaced with another magazine that has been pre-loaded.

The description has proceeded on the basis that mandrel 27 is a flexible tube. The mandrel could however be formed as a flexible solid plastic rod, as shown in FIG. 8. The rod construction may be particularly advantageous in the small mandrel diameters of about one eighth inch. FIG. 8 shows a conical nose piece 62 formed integrally with the mandrel for facilitating stringing of the collars onto the rod. FIG. 8 also shows an alternate construction for the associated retainer. In this case the retainer is an elongated pin 63 extending as a friction fit through a transverse hole in the mandrel.

It is believed that the invention can be formed in various different structural configurations, as come within the limits of the appended claims. A principal advantage of the invention is that the mandrel-collar assembly is assembled to exclude extraneous slugs, dirt or wrong size collars. When the mandrel is withdrawn from the magazine the collars are in a clean lubricated condition, such that feeding device 8 has an improved ability to continuously operate in a jam-free condition.

What is claimed is:

1. In a fastening system including a pin and a tubular collar with said pin having an elongated shank portion terminating at one end in an enlarged head portion and with said collar adapted to be located on said shank portion and to be swaged thereon and with the fastening system including a collar feeding device adapted to automatically feed such collars onto such pins in preparation for installation with said collar feeding device having a flexible, tubular magazine for receiving and storing a plurality of said collars for sequential feeding onto said pins, and with the fastening system further including a collar loading device including a flexible, tubular loading tube having a preselected tube inside diameter, the fastening system further including a fastening collar assembly for holding a plurality of said collars and operatively associated with said tubular magazine for loading said collars into said tubular magazine;

said fastener collar assembly, comprising:

an elongated flexible mandrel having a first end portion and a second end portion and adapted to receive a plurality of said collars;

each of said collars having a through bore with a preselected inside bore diameter and having an outer surface of a preselected outside surface diameter, said flexible mandrel adapted to be located within said tubular loading tube generally in coaxial relationship with said tube inside diameter, bore sizing means located at least at said second end portion of said mandrel for accepting thereon said collar having said through bore of said preselected inside bore diameter and rejecting collars with a through bore of a smaller diameter, said preselected outside diameter being selected relative to said loading tube inside diameter whereby said collars of said preselected outside diameter can be accepted into the tubular loading tube while collars of larger outside diameter are rejected, first retainer means provided on said first end portion of said mandrel;

second retainer means provided on said second end portion of said mandrel;

a plurality of said collars mounted on said mandrel and releasably retained thereon between said first and second retainer means;

whereby said collars on said mandrel of said fastener assembly to be loaded into said tubular magazine will be of uniform size.

2. The assembly of claim 1, wherein said first retainer means comprises a releasable retainer means for axially releasing said collars from said mandrel.

3. The assembly of claim 2, wherein said releasable retainer means comprises a deformable portion responsive to an axial force applied between said collars and said mandrel.

4. The assembly of claim 1, wherein said first retainer means comprises a radially collapsible portion for releasing said collars from said mandrel into said tubular magazine in response to a preselected relative axial force applied between said collars and said mandrel.

5. The assembly of claim 1, wherein said second retainer means extends further radially outwardly than said first retainer means.

6. The assembly of claim 1, wherein said first retainer means comprises a radially outwardly deformed portion of said mandrel.

7. The assembly of claim 1, wherein said mandrel comprises a plastic tube.

8. In a fastening system for installing fasteners with each fastener including a pin and a tubular collar with said pin having an elongated shank portion terminating at one end in an enlarged head portion and with said collar adapted to be located on said shank portion and to be swaged thereon, said fastening system comprising:

(a) collar feeding means for automatically feeding said collars onto said pins in preparation for installation, said collar feeding means including a flexible, tubular magazine for receiving and storing a plurality of said collars for sequential feeding onto said pins, (b) fastener collar assembly for holding a plurality of said collars and operatively associated with said tubular magazine for loading said collars into said tubular magazine;

said fastener collar assembly, comprising:

an elongated flexible mandrel having a first end portion and a second end portion and adapted to receive a plurality of said collars;

each of said collars having a through bore with a preselected inside bore diameter and having an outer surface of a preselected outside surface diameter, (c) collar loading means for loading said plurality of said collars onto said flexible mandrel, said collar loading means including a flexible, tubular loading tube having a tube inside diameter of a preselected magnitude relative to the magnitude of said outside surface diameter of said collars, said flexible mandrel adapted to be located within said tubular loading tube generally in coaxial relationship with said tube inside diameter with said second end portion of said mandrel positioned to receive said plurality of collars, collar bore sizing means located at least at said second end portion of said mandrel for accepting thereon said collars having said through bore of said preselected inside bore diameter and rejecting collars with a through bore of a smaller diameter, said loading tube inside diameter being selected relative to said preselected outside diameter of said collars whereby said collars of said preselected outside diameter can be accepted into said tubular loading tube while collars of larger outside diameter are rejected, said flexible mandrel having first retainer means on said first end portion of said mandrel for releasably supporting said plurality of collars on said flexible mandrel;

second retainer means operatively associated with said second end portion of said mandrel after loading of said plurality of collars onto said mandrel for holding said plurality of collars thereon;

whereby said plurality of said collars are mounted on said mandrel will be of a uniform size and releasably retained thereon between said first and second retainer means for loading into said tubular magazine of said collar feeding means.

9. In a fastening system for installing fasteners with each fastener including a pin and a tubular collar with said pin having an elongated shank portion terminating at one end in an enlarged head portion and with said collar adapted to be located on said shank portion and to be swaged thereon, said fastening system comprising:

(a) collar feeding means for automatically feeding said collars onto said pins in preparation for installation, said collar feeding means including a flexible, tubular magazine for receiving and storing a plurality of said collars for sequential feeding onto said pins, (b) fastener collar assembly for holding a plurality of said collars and operatively associated with said tubular magazine for loading said collars into said tubular magazine;

said fastener collar assembly, comprising:

an elongated flexible mandrel having a first end portion and a second end portion adapted to receive a plurality of said collars;

each of said collars having a through bore with a preselected inside bore diameter and having an outer surface of a preselected outside surface diameter, (c) collar loading means for loading said plurality of said collars onto said flexible mandrel, said collar loading means including vibrating bowl means for axially orienting said collars, said collar loading means including a flexible, tubular loading tube having a tube inside diameter of a preselected magnitude relative to the magnitude of said outside surface diameter of said collars, said loading tube being operatively associated with said vibrating bowl means for receiving said collars from said vibrating bowl means, said flexible mandrel adapted to be located within said tubular loading tube generally in coaxial relationship with said tube inside diameter with said second end portion of said mandrel positioned to receive said plurality of collars entering said loading tube from said vibrating bowl means, collar bore sizing means located at least at said second end portion of said mandrel for accepting thereon said collars having said through bore of said preselected inside bore diameter and rejecting collars with a through bore of a smaller diameter, said loading tube inside diameter being selected relative to said preselected outside diameter of said collars whereby said collars of said preselected outside diameter can be accepted into said tubular loading tube while collars of larger outside diameter are rejected, said flexible mandrel having first retainer means on said first end portion of said mandrel for releasably supporting said plurality of collars on said flexible mandrel;

second retainer means operatively associated with said second end portion of said mandrel after loading of said plurality of collars onto said mandrel for holding said plurality of collars thereon;

whereby said plurality of said collars as mounted on said mandrel will be of a uniform size and releasably retained thereon between said first and second retainer means for loading into said tubular magazine of said collar feeding means.

10. In a fastening system for installing fasteners with each fastener including a pin and a tubular collar with said pin having an elongated shank portion terminating at one end in an enlarged head portion and with said collar adapted to be located on said shank portion and to be swaged thereon, said fastening system comprising:

(a) collar feeding means for automatically feeding said collars onto said pins in preparation for installation, said collar feeding means including a flexible, tubular magazine for receiving and storing a plurality of said collars for sequential feeding onto said pins, (b) fastener collar assembly for holding a plurality of said collars and operatively associated with said tubular magazine for loading said collars into said tubular magazine;

said fastener collar assembly, comprising:

an elongated flexible mandrel having a first end portion and a second end portion and adapted to receive a plurality of said collars;

each of said collars having a through bore with a preselected inside bore diameter and having an outer surface of a preselected outside surface diameter, (c) collar loading means for loading said plurality of said collars onto said flexible mandrel, said collar loading means including vibrating bowl means for axially orienting said collars, said collar loading means including a flexible, tubular loading tube having a tube inside diameter of a preselected magnitude relative to the magnitude of said outside surface diameter of said collar, said loading tube being operatively associated with said vibrating bowl means for receiving said collars from said vibrating bowl means, said flexible mandrel adapted to be located within said tubular loading tube generally in coaxial relationship with said tube inside diameter with said second end portion of said mandrel positioned to receive said plurality of collars entering said loading tube from said vibrating bowl means, collar bore sizing means located at least at said second end portion of said mandrel for accepting thereon said collars having said through bore of said preselected inside bore diameter and rejecting collars with a through bore of a smaller diameter, said loading tube inside diameter being selected relative to said preselected outside diameter of said collars whereby said collars of said preselected outside diameter can be accepted into said tubular loading tube while collars of larger outside diameter are rejected, said flexible mandrel having first retainer means on said first end portion of said mandrel for releasably supporting said plurality of collars on said flexible mandrel;

said loading tube being selectively removably secured to said vibrating bowl means, second retainer means operatively associated with said second end portion of said mandrel after loading of said plurality of collars onto said mandrel and after removal of said loading tube from said vibrating bowl means for holding said plurality of collars thereon;

whereby said fastener collar assembly will be a portable unit with said plurality of said collars as mounted on said mandrel being of a uniform size and releasably retained thereon between said first and second retainer means for loading into said tubular magazine of said collar feeding means.

* * * * *